US005725369A

United States Patent [19]

Tsai

[11] Patent Number: 5,725,369

[45] Date of Patent: Mar. 10, 1998

[54] GAS TORCH HAVING A GAS REGULATING DEVICE

[76] Inventor: Chin-Lin Tsai, 3F, No. 94, Sec. 4, Chung Hsin Rd., San Chung City, Taipei Hsien, Taiwan

[21] Appl. No.: 806,608

[22] Filed: Feb. 26, 1997

[51] Int. Cl.[6] ..... F23D 14/28

[52] U.S. Cl. ..... 431/344; 431/255; 431/345; 126/407; 126/413; 137/508; 137/512.2

[58] Field of Search ..... 431/344, 255, 431/266, 247, 244, 232, 233, 203, 206, 143, 345; 126/405, 406, 407; 137/508, 505, 505.25, 505.14, 495, 510, 512.2

[56] References Cited

U.S. PATENT DOCUMENTS 5,071,342 12/1991 Yoshinaga ..... 431/264
5,466,149 11/1995 Tsai ..... 431/255
5,467,738 11/1995 Tsai ..... 431/344
5,476,376 12/1995 Santhouse et al. ..... 431/344
5,531,592 7/1996 Tsai ..... 431/266
5,564,919 10/1996 Tsai ..... 431/344
5,573,393 11/1996 Tsai ..... 431/255

*Primary Examiner*—James C. Yeung
*Attorney, Agent, or Firm*—Bacon & Thomas

[57] ABSTRACT

A gas torch having a body provided with a connected socket to install a gas-can thereof. A control device is connected to top of the body to control the supply and shutoff of the gas flow. The body is connected with a regulating device to ensure a complete vaporization of liquefied gas and keep the gas pressure constantly. The gas is directed to an injected orifice via a preset route within the body. The injected gas is well mixed within a burning nozzle and ignited by piezo electricity device. Those described components are enclosed by a housing. A branching rod and a baking tube such that the gas torch can be served as a baking device. The burning nozzle can be readily replaced with another type and different flame patterns can be attained.

12 Claims, 5 Drawing Sheets

GAS TORCH HAVING A GAS REGULATING DEVICE

FIELD OF THE INVENTION

The present invention relates to a gas torch, more particularly, to a gas torch fueled with gas-can wherein the liquefied gas can be readily vaporized without passing the loop-type pre-heating device. Consequently, a complete combustion can be attained and the safety can be ensured.

DESCRIPTION OF PRIOR ART

U.S. Pat. Nos. 5,082,440 and 5,531,592 issued to the applicant of this application have disclosed a handy gas torch which is fueled by liquefied gas of a lighter.

However, the handy gas torch is limited by the volume of liquefied gas contained within a lighter, accordingly, the gas torch can not lasts long for heating. In light of this, the gas can is applied for heating which shall last for a comparatively longer time.

Because of the availability and convenience of the gas-can, the gas torch disclosed in U.S. Pat. No. 5,446,149, issued to the applicant of the present invention, is used to adapt a gas can from the bottom of the gas torch such that the liquefied gas is injected into the storing tank of the gas torch. Accordingly, the gas torch can be fueled with the liquefied gas.

In the other type, for example, the gas torch disclosed in U.S. Pat. No. 4,804,324, issued to Prince Industrial Development Co., Ltd., is provided with a connecting device such that the gas-can can be pivotally connected thereof. When the liquefied gas is vaporized, the gas torch can be fueled with such gas for melting, welding or the likes.

In the gas torch having a storing tank thereon, the gas-can is pivotally connected to the gas torch such that the liquefied gas is injected into the storing tank. Nevertheless, during the fueling process, the pressure of the gas is reduced tremendously such that the flame resulted from burning the gas supplied from pertinent tubes is considerably small. Accordingly, this gas torch can only be applied on heated welding, melting and drying processes. On the other hand, when the gas torch is connected with a gas-can, the vaporized flame resulted from burning the gas supplied directly from the gas-can is comparatively larger and can be applied on large scale burning process. However, when the user performs a melting, welding and drying process which the gas torch having attached there of a gas-can which is held up side down, the liquefied gas will directly injected to the object to be heated before it is directly vaporized resulted from high pressure of the gas can. Accordingly, an incompletely burning will occur. If this is the case, the burning performance will not be enhanced, furthermore, it may bring a dangerous situation to the user.

In light of this, controlling and regulating suitably the burning pressure of the vaporized gas is a main problem to be solved as the gas-can is used to fuel the gas torch.

SUMMARY OF THE INVENTION

It is the object of this invention to provide a gas torch having a gas regulating device wherein the burning performance can be enhanced and the gas is consumed in a more economic way.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
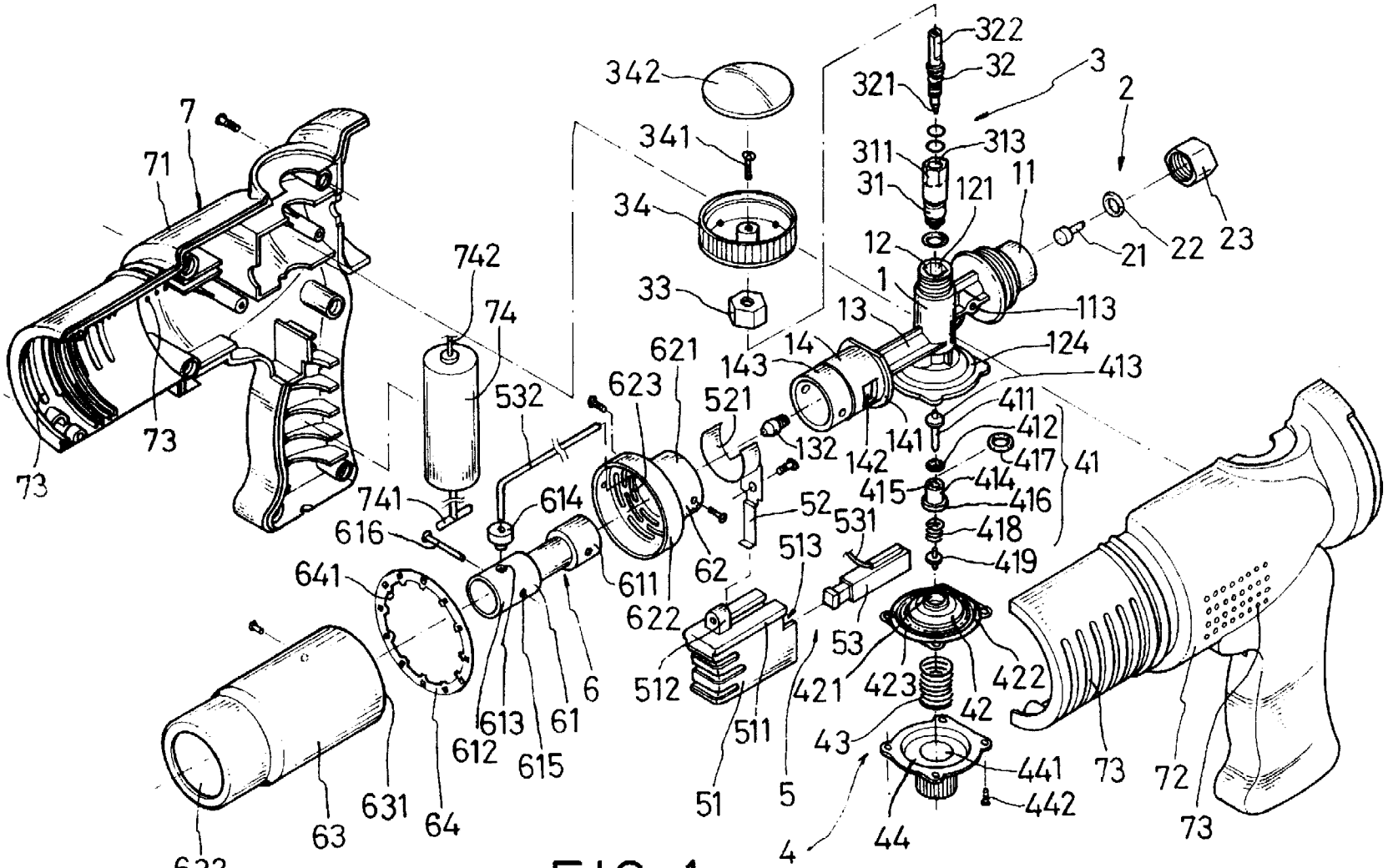
FIG. 1 is an exploded perspective view of the gas torch made according to the present invention.

Referring to Figures, the gas torch made according to the present invention generally comprises a body 1, a pivoting device 2, a control device 3, a gas regulating device 4, a piezoelectricity device 5, a burning nozzle 6 and a housing 7.

Figure 2:
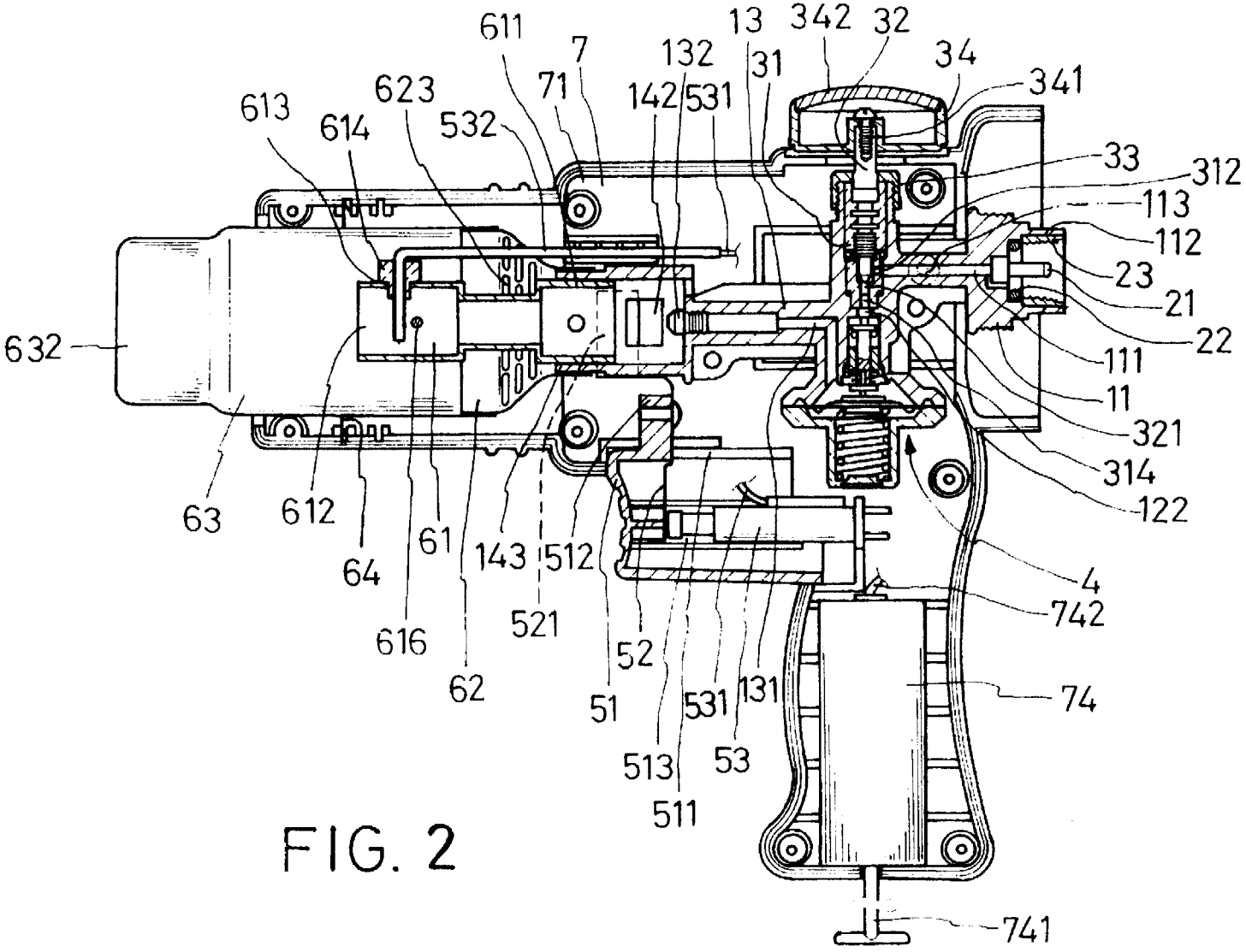
FIG. 2 is a cross sectional view of the gas torch shown in FIG. 1 as it is assembled.

Referring to FIGS. 1 and 2, the body 1 is integrally formed and is provided with a connecting socket 11 at the rear end such that the gas from the gas-can may pass through the slot 111 of the connecting socket 11. The body 1 is provided with a chamber 12 having a formed hole 121 for receiving and retaining a controlling device 3. After the gas is adjusted by the controlling device 3, the gas is passed through the neck portion 122 of the chamber 12 and entered the regulating device 4. By the adjustment of the regulating device 4, the liquefied gas is completely vaporized and the remained in a stable pressure. Afterward, the regulated gas is passed through the duct 131 of the tube 13 and is injected by the injecting orifice 132 disposed thereof. In order to connect the body 1 with the burning nozzle 6, an extended socket 14 having a flange 141 is disposed at the tube 13. The peripheral of the flange 141 is provided with one or more than one holes 142 for air supplying and enhancing the combustion. The front portion of the extended socket 14 is provided with a dowel 143 for connecting with the burning nozzle 6 thereon. Accordingly, the mixture of gas and air can be supplied to the burning nozzle 6.

The pivoting device 2 is used to attach a gas-can thereof after it is connected to the connecting socket 11, by this arrangement, the liquefied gas can be supplied into the body 1. In the preferred embodiment of the pivoting device 2, it comprises a needle 21 and an O-ring 22 retained within the opening of the slot 111. Afterward, a formed nut 23 can be locked onto the threaded hole 112 of the connecting socket 11. By this arrangement, the formed nut 23 is completely locked with the gas-can such that the needle 21 may open the valve of the gas-can for gas supplying.

The control device 3 is used to supply/stop the gas supplied from the slot 111 to burning nozzle 6 and regulates the gas flow to the same when it is connected to the chamber 12. In the preferred embodiment of the control device 3, the control device 3 includes a barrel 31 to be retained within the chamber 12. The formed end 311 in the top and the formed hole 121 may establish a positioning relationship with each other. The barrel 31 is provided with a side hole 312 respect to the slot 111 to let the gas to be supplied into the barrel slot 313. The barrel slot 313 is further received with an adjusting rod 32. When the adjusting rod 32 is rotated, the bottom of the dowel 321 will close and/or open the neck 314 of the barrel 31 to control the gas into the regulating device 4. Furthermore, a cover 33 which passes over the post 322 of the threaded rod 32 and locked with the outer wall of the chamber 12 such that the barrel 31 and the threaded rod 32 are prevented from escaping from the chamber 12. Afterward, a screw 341 is applied to lock after a rotating knob 34 is enveloped onto the post 322. Then, a finish 342 is applied to enclose the upper opening of the rotating knob 34. When the rotating knob 34 is rotated, the threaded rod 32 is moved inward within the barrel 31 such that the gas supplied can be stopped.

As shown in FIGS. 1 to 4, the regulating device 4 is disposed in the bottom of the body 1. The regulating device 4 generally includes a central slot 123 disposed in the neck 122 of the body 1. The bottom is formed with a stepped upper disk 124 defining a upper disk chamber 125 therein. The side portion is provided with a duct 131 to form a gas supplying route. The regulating device 4 includes a valve 41, a membrane 42, a coil spring 43 and a lower disk 44. The valve 41 includes a central rod 411 having an O-ring 412 enveloped thereon. The O-ring 412 is stopped by a retaining ring 413. The barrel 414 is provided with a shaft hole 415 for the central rod 411 passing therethrough. The enclosing ring 416 disposed at the lower end of the central rod 411 is disposed with an O-ring 417. The central rod 311 is connected with a coil spring 418 after it passes through the shaft hole 415. The bottom of the central rod 411 is welded with a bottom dowel 419. The barrel 414 is retained within the central slot 123. By this arrangement, the gas may passes the shaft hole 415 after the gas passes through the neck 122 and the central slot 123. Then the gas may enter the upper disk chamber 125 and comes out via the duct 131.

The membrane 42 is made from resilient material. The outer shape has a stepped disk configuration such that the upper disk 124 and lower disk 44 are disposed therein. The membrane 42 is provided with a membrane hole 421 respect to the bottom dowel 419. The disk slot 126 disposed at the bottom of the upper disk 124 is provided with a formed dowel 422 respectively for retaining thereof. Furthermore, the membrane 42 is provided with a membrane ring 423 having a thinner thickness in the central portion. The membrane 42 further includes a projected ring 424 opposite to the membrane hole 421 for receiving a spring 43 disposed thereon such that the spring 43 can be disposed within the lower disk chamber 441 of the lower disk 44. Then the four corners of the lower disk 44, membrane 42 and the upper disk 124 can be aligned with each other. Then a screw 442 can be applied to lock them up, then the regulating device 4 is assembled.

Figure 4:
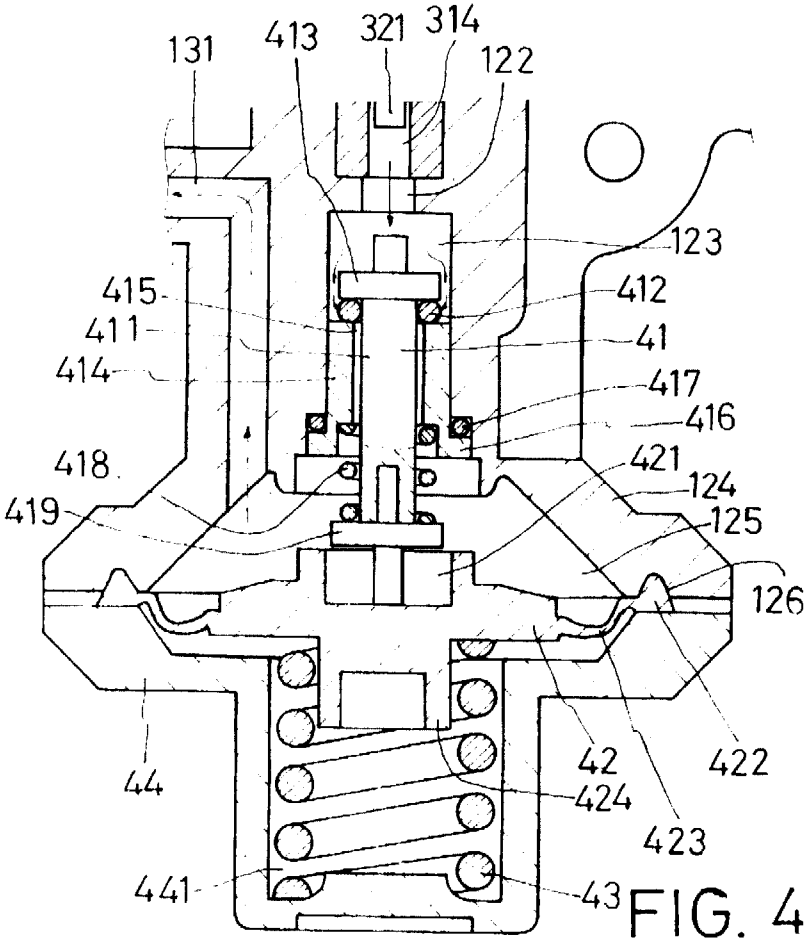
FIG. 4 is a cross sectional view of a gas regulating device wherein the gas is shut-off.
Figure 3:
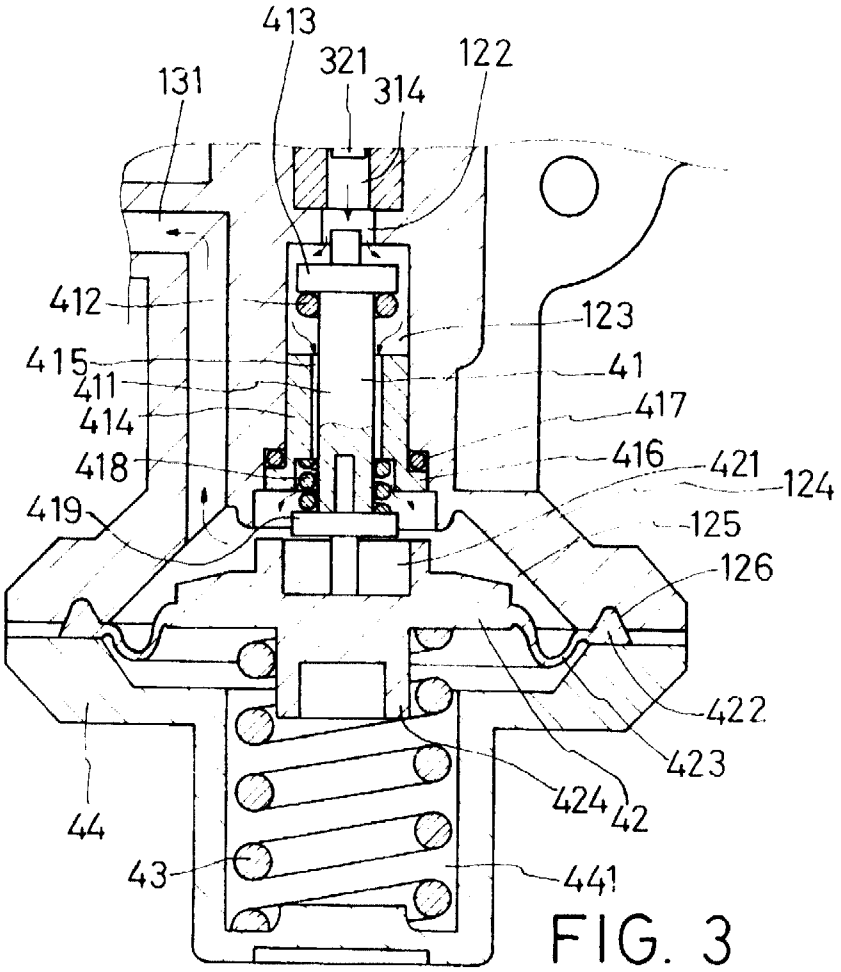
FIG. 3 is a cross sectional view of the gas torch shown in FIG. 1 wherein the gas is supplied thereof.

Referring to FIGS. 3 and 4, the working principle of the regulating device 4 of the present invention will be detailedly described as below. When the gas supplied from the control device 3 enters the neck 122, the gas will pass over the central slot 123 and the shaft hole 415 and stays in the upper disk chamber 125 disposed above the membrane 42. Then the gas will be injected from the injecting orifice 132 via the duct 131. Since the injecting orifice 132 has a comparatively small inner diameter, the upper disk chamber 125 will be quickly filled with the excess gas or liquefied gas such that the pressure within the upper disk chamber 125 will be rapidly increased. In this case, the increased gas pressure will actuate the membrane 42 to move downward such that the spring 43 is compressed downward and the coil spring 419 is extended to move the bottom dowel 418 together with the central rod 411. Accordingly, the shaft hole 415 will be sealed by the O-ring 412 disposed such that the supplied gas is stopped, as detailedly shown in FIG. 4.

When the liquefied gas filled within the upper disk chamber 125 is discharged from the duct 131 gradually, the gas pressure within the upper disk chamber 125 is reduced such that the spring 43 is resumed to its original position. Accordingly, the membrane 42 is pushed upward and the central rod 411 is pushed upward as the coil spring 418 is pushed by the dowel 419. When the central rod 411 is moved up, the shaft hole 415 is released from the O-ring 412 and the gas is again supplied to the upper disk chamber 125 via the same route. Since the gas moves in and out from the upper disk chamber 125 very quickly, accordingly, the membrane 42 moves up and down continuously such that the liquefied gas is completely vaporized which in turn benefits a complete combustion of gas. By the provision of the regulating device 4, the gas torch fueled with gas-can may not be additionally equipped with a pre-heating loop device and the accessories.

The piezoelectricity device 5 includes a key 51 having a sliding dowel 511 at both sides. Those sliding dowels 511 are further connected to the corresponding slob disposed on the housing 7 for guiding purpose. The key 51 is provided with a key dowel 512 atop which is interconnected with a conducting plate 52. The conducting plate 52 is extended into the slot chamber 531 with its lower end. The slot chamber 531 is further provided with a piezo means 53 having a conducting wires 531 enveloped with a insulating tube 532. The piezo means 53 is extended into the burning nozzle 6 to ignite the mixture within the burning nozzle 6.

On the other hand, in order to adjust the ratio between the gas and air such that the mixture can be readily ignited, the conducting plate 52 is provided with a barrier plate 521 having the same radius with the extended socket 14. By this arrangement, when the key 51 is depressed, the conductive plate 52 is moved back simultaneously such that the hole 142 is shielded by the barrier plate 521 such that the mixing ratio of the air and gas can be set to 7:3. With this mixing ratio, the mixture can be readily ignited. When the key 51 is released, by the rebounding of the piezo means 51, the barrier plate 521 will be moved away from the hole 142, the mixing ratio is returned to 9:1 such that a completely combustion can be attained.

The burning nozzle 6 generally comprises a tail portion 611 of a mixing tube 61 attached to an end dowel 143 for receiving the mixture of gas and air. The front portion 612 is provided with a pilot hole 613. An insulating socket 614 made from fire-proof material is disposed within the pilot hole 613 for receiving and retaining an insulating tube 532 thereof. When the key 51 is depressed, the end portion of the conducting wire 531 will generate an electric are with the inner wall of the mixing tube 61 such that the mixture of gas and air can be ignited. Then a combustion is commenced Furthermore, if the flame needs to be reduced for welding and drying, referring to FIGS. 1 to 5, a branching rod 616 can be provided. It is achieved by providing a through hole 615 on the front portion 612 for receiving and retaining a branching rod 616 thereof. In principle, the insulating tube 532 is perpendicular to the branching rod 616 and when the flame passes through this cross configured by the insulating tube 532 and the branching rod 616, the core of the flame will be spit such that the intensity of the flame is retarded.

Besides, the gas torch may also serve as a baking device except as the burning device. A connecting cap 62 having an end cap 621 is connected with an end dowel 143 and the cap flange 622 extended forward is provided with a plurality of insulating slots 623 each of them is cross to each other. By this arrangement, the heat transmitted to the body 1 is reduced. Further more, a baking tube 63 having it opening 631 connected to the cap flange 622 is provided. Accordingly, the flame generated by the burning nozzle 6 is limited within the baking tube 63 and the heated air from the opening 632 can be used to de-paint, shrink film, soften, drying and de-frozen or even melt snow. Furthermore, in order to prevent the heat to be transmitted to the housing 7, the baking tube 63 is enveloped with an insulating ring 64. The insulating ring 64 is provided with a plurality of projections 641 increase the gap between the baking tube 63 and the inner wall of the housing 7. By this arrangement, the baking tube 63 can be suitable positioned within the housing 7 while it is also well insulated.

Figure 6:
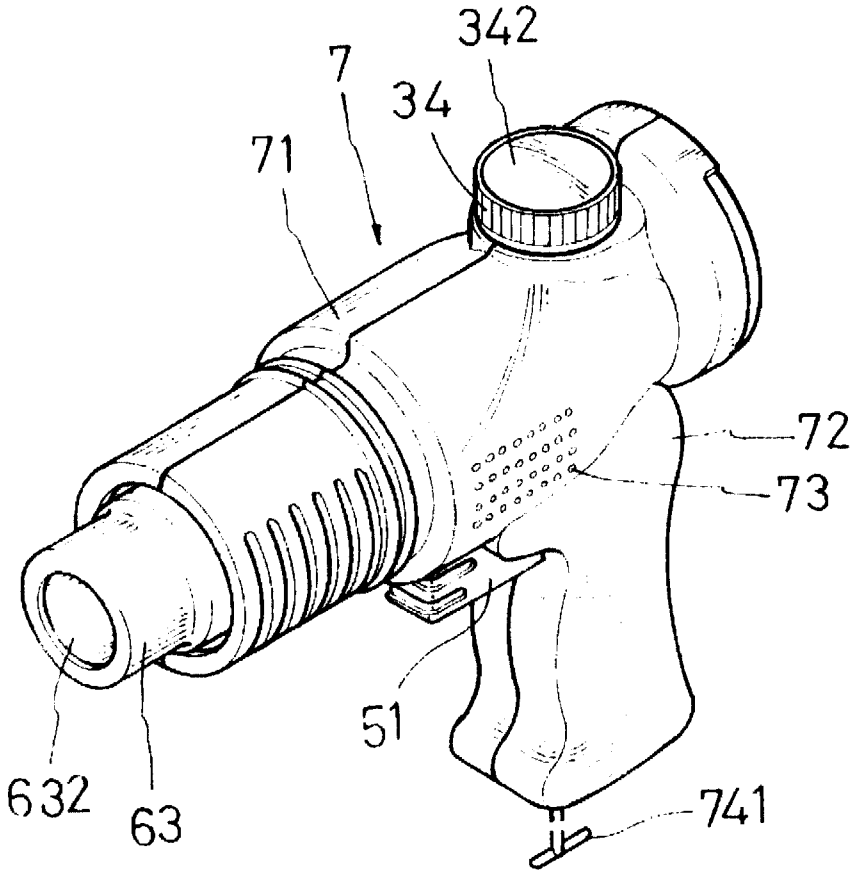
FIG. 6 is a perspective view of the gas torch made according to the present invention.

The housing 7 is configured by a left half 71 and a right half 72 which jointly defines space therebetween for receiving and enclosing those described components. The inner wall of both halves 71 and 72 is provided with a plurality of dowels and holes for positioning aforesaid components. When those components are completely assembled, it is shown in FIG. 6. On the other hand, the outer surface of the housing 7 is provided with a plurality of ventilating holes 73 to dissipate the heat generated within the housing 7. In light of this, the overheat within the housing 7 is avoided. On the other hand, in order to solve the vaporization process which is difficult to proceed in coldest region, a pump 74 is provided on the handle portion of the housing 7. The lower portion is provided with a pushing rod 741 and a delivery tube 742 is disposed above and which is connected to an air supplying hole 113. When the pushing rod 741 is pushed inward, the compressed air is delivered to the slot 111 of body 1 via the air supplying hole 113 and the delivery tube 742, accordingly, the gas can be well mixed with the air and is further charged.

Figure 7:
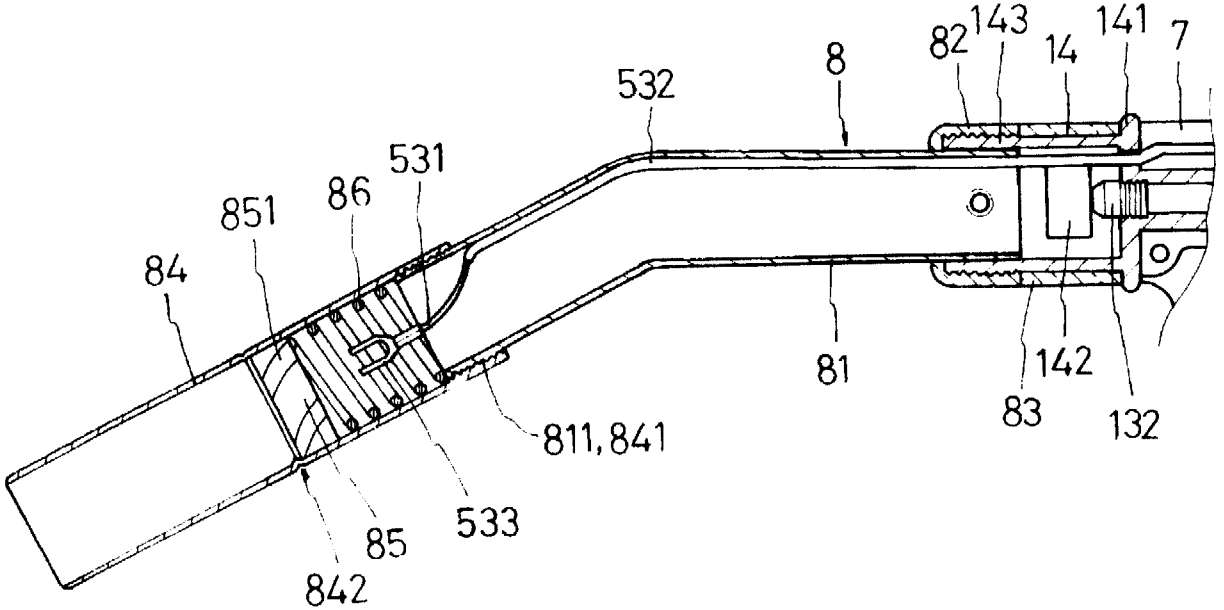
FIG. 7 is another embodiment of the gas torch made according to the present invention.
Figure 5:
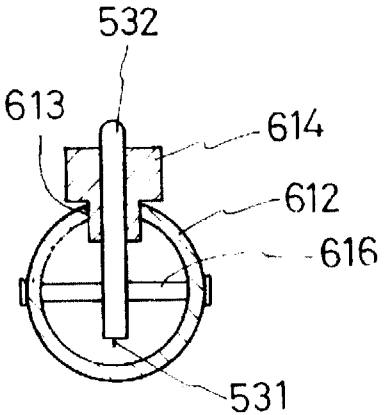
FIG. 5 is a side cross sectional view of the branching device.

Referring to FIG. 7 which is a schematic illustration of a second embodiment of burning nozzle 8. The burning nozzle 8 includes a loop tube 81 connected to a dowel 143. Then a knob 82 is screwed onto the outer threaded portion on the outer surface of the end dowel 143. An adjusting knob 83 having an air passage (not shown) can be disposed between the knob 82 and the end portion 141. When the air passage of the adjusting knob 83 is aligned with the hole 142, the air can be supplied to the extended socket 14. This supplied air is mixed with the gas from the injecting orifice 142 and flow into the bop tube 81. Besides, the threaded portion 811 of the other end portion of the loop tube 81 is screwed with an inner threaded portion 841 of a corresponding outer tube 84. The outer tube 84 is provided with a pressing thread 842 such that the burning nozzle 85 having a plurality of circular slot 851 can be stopped by the pressing thread 842 such that it may not separate from the outer tube 84. Besides, a spring 86 is disposed between the burning nozzle 85 and the loop tube 81 such that the burning nozzle 85 can be positioned. The conductive wire 531 enclosed with an insulating tube 532 of the piezo electricity device 5 is directed to the extended socket 14 and the loop tube 81 and positioned adjacent to the burning nozzle 85. Accordingly, when an electrical arc is generated, the mixture of gas and air can be ignited. In this embodiment, the flame generated by the burning nozzle 85 has a spiral configuration. Accordingly, the ignition of mixture can be readily done. Furthermore, the end of the conductive wire 531 is connected to a Y-shape terminal 533. By this arrangement, the electrical arc is generated between both wings of the Y-shape terminals 533.

By the provision of the regulating device of the present invention, the liquefied gas can be completely vaporized and maintained in constant vaporized pressure. Accordingly, the gas flow supplied to the burning device is suitable to ensure the safety of the user. Besides, the barrier plate will shield the air supplying hole when the key is pressed such that the mixing ration between the gas and air can be immediately modified to ensure a successful ignition. The gas torch has also being provided with a branching rod and baking tube such that the gas torch can be served as a baking device. The gas torch made according to the present invention is also provided with an air pump to enhance the vaporization of liquefied gas. The vaporized gas is also charged during the pumping process. Apparently, those features provided by the present invention are apparently over the conventional art on both purposes, measures and functions. The burning nozzle can be replaced with other types of nozzle to increase the burning performance and reduce the operating time.

While particular embodiment of the present invention has been illustrated and described, it would be obvious to those skilled in the art that various other changes and modifications can be made without departing from the spirit and scope of the invention. It is therefore intended to cover in the appended claim all such changes and modifications that are within the scope of the present invention.

I claim:

1. A gas torch, comprising:

a body which is integrally formed and being provided with a connecting socket having a slot directed to a chamber disposed longitudinally, the bottom of said body being provided with a neck portion connecting a central slot and an upper disk plate such that the chamber defined by said upper disk plate can be connected with a duct of a tube, the tube being extended with an extended socket having a flange at rear portion, the peripheral of said flange being provided with one or at least one holes for air supplying, the front portion being provided with end dowels disposed in stepping manner;

a pivoting device being connected to said connecting socket such that a gas-can can be attached thereof for supplying vaporized gas therefrom;

a control device 3 being connected to said chamber for supplying/stopping the gas supplied from said slot to said control device;

a regulating device being disposed in the bottom of said body, said regulating device including a valve, a membrane, a coil spring and a lower disk, said valve including a central rod having an O-ring enveloped thereon, said O-ring being stopped by a retaining ring and a barrel being provided with a shaft hole for said central rod passing therethrough, the lower end of said central rod being connected with a coil spring after it passes through said shaft hole and the bottom of said central rod being welded with a bottom dowel such that said central rod can be moved up and down, said membrane being made from resilient material and having a stepped disk configuration such that said upper disk and said lower disk being disposed therein, said membrane being provided with a membrane hole for receiving a bottom dowel therein, said membrane being provided with a membrane ring having a thinner thickness in the central portion, said membrane further including a projected ring opposite to said membrane hole for receiving a spring disposed thereon such that said spring can be disposed within said lower disk chamber of said lower disk, wherein said lower disk, membrane and the upper disk can be aligned and connected with each other, wherein when the gas is supplied to the upper disk chamber via those described route, the excess gas pressure will move said membrane and coil spring downward simultaneously such that said coil spring is extended to move said central rod downward which in turn closes said shaft hole by means of said O-ring, by this arrangement, said liquefied gas will keep on vaporizing and the pressure of it will be remained constantly, when the gas pressure within said upper disk chamber is reduced, said membrane and said spring will resume to its original position such that said central rod is moved upward to release said shaft hole, accordingly, the gas is again supplied to said upper disk chamber;

an piezoelectricity device including a key disposed at said housing, said key being interconnected with a conducting plate and a piezo means having a conducting wires enveloped with a insulating tube, said piezo means being extended into a burning nozzle to ignite the mixture of gas and air therein;

a burning nozzle generally including a tail portion of a mixing tube attached to an end dowel for receiving the mixture of gas and air which can be injected through its front opening, the end portion of said conducting wire being extended into said mixing tube via a front hole to ignite the mixture of gas and air can be ignited; and a housing being configured by a left half and a right half which jointly defines space therebetween for receiving and enclosing those described components, the inner wall of said halves being provided with a plurality of dowels and holes for positioning aforesaid components.

2. A gas torch as recited in claim 1, wherein the conducting plate further comprising a barrier plate corresponding to said extended socket, by this arrangement, when said key is depressed, said conductive plate is moved back simultaneously such that said hole is shielded by said barrier plate such that the mixing ratio of the air and gas can be set optimally to ensure the ignition.

3. A gas torch as recited in claim 1, wherein said mixing tube further includes a through hole on the front portion for receiving and retaining a branching rod such that a cross configured is attained by said mixing tube and said branching rod to split the intensity of the flame.

4. A gas torch as recited in claim 1, further comprising a baking device which includes a connecting cap having an end cap is connected with an end dowel, the cap flange extended forward is provided with a plurality of insulating slots each of them is cross to each other to reduce the heat transmitted to said body, a baking tube having it opening connected to said cap flange being provided such that the flame generated by said burning nozzle is limited within said baking tube and the heated air is injected from said opening.

5. A gas torch as recited in claim 1, wherein said baking tube can be connected with an insulating ring having a plurality of projections which establish a point-to-point contact between said insulating ring and said baking tube such that said baking tube can be positioned with said housing in a heat retarded manner.

6. A gas torch as recited in claim 1, wherein said housing includes a pump provided on the handle portion, the lower portion is provided with a pushing rod extended externally and a delivery tube is disposed above and which is connected to an air supplying hole, when said pushing rod is pushed inward, the compressed air is delivered to the slot of body such the gas can be well mixed with the air and is further charged.

7. A gas torch as recited in claim 1, wherein said burning nozzle includes a loop tube connected to a dowel, a knob is connected to said end dowel, an adjusting knob having a passage can be disposed between said knob and said end portion, the other end portion of said loop tube is connected with a corresponding outer tubes, said outer tube is provided with a pressing thread and a spring is disposed between said burning nozzle and said loop tube such that the mixture injected by the circular slot of said burning nozzle can be ignited by said conducting wires of said piezo electricity device.

8. A gas torch as recited in claim 1, wherein the conducting wire is connected with a Y-shape terminal at one end such that an electric arc can be generated thereon.

9. A gas torch as recited in claim 1, wherein the bottom of said membrane is provided with a formed dowel corresponding to said upper disk plate such that said membrane and said upper disk plate can be readily aligned and interconnected.

10. A gas torch, comprising:

a body having being provided with passage for gas and which in turn connects a central slot and a upper disk plate defining a disk chamber therein, said disk chamber being connected with a discharge port to output the gas;

a valve being disposed within said central slot, said valve including a central rod having an O-ring enveloped thereon and which in turn passes a shaft hole of a barrel, an enclosing ring disposed at the lower end of said barrel being disposed with an O-ring and which in turn is disposed within said central slot, said central rod being connected with a coil spring after it passes through said shaft hole, the bottom of said central rod being welded with a bottom dowel such that said central rod can be moved upward and downward;

a membrane being made from resilient material, said membrane being configured such that said upper disk and lower disk can be disposed therein, said membrane being provided with a membrane hole respect to the bottom dowel, said membrane being provided with a membrane ring having a thinner thickness in the central potion, a projected ring being extended from bottom portion;

a coil spring to be engaged with said projected ring;

a lower disk corresponding to said upper disk, a lower disk chamber being defined for receiving said coil spring and said coil spring, said lower disk, said membrane and said upper disk being interconnected in orderly;

wherein when the gas is supplied to the upper disk chamber via those described route, the excess gas pressure will move said membrane and cell spring downward simultaneously such that said coil spring is extended to move said central rod downward which in turn closes said shalt hole by means of said O-ring, by this arrangement, said liquefied gas will keep on vaporizing and the pressure of it will be remained constantly, when the gas pressure within said upper disk chamber is reduced, said membrane and said spring will resume to its original position such that said central rod is moved upward to release said shaft hole, accordingly, the gas is again supplied to said upper disk chamber.

11. A gas torch as recited in claim 10, wherein the bottom of said membrane is provided with a formed dowel corresponding to said upper disk plate such that said membrane and said upper disk plate can be readily aligned and interconnected.

12. A gas torch as recited in claim 1, wherein the operating speed of said membrane is dependent to the ratio between said upper disk chamber and said discharge tube.

* * * * *